United States Patent [19]

Mashuda

[11] 4,407,543

[45] Oct. 4, 1983

[54] MECHANIZED WHEELCHAIR

[76] Inventor: David Mashuda, R.D. #1, Evans City, Pa. 16033

[21] Appl. No.: 316,680

[22] Filed: Oct. 30, 1981

[51] Int. Cl.[3] ..... A61G 5/04

[52] U.S. Cl. ..... 297/330; 297/DIG. 4; 297/DIG. 10; 180/DIG. 3

[58] Field of Search ..... 180/DIG. 3; 280/657; 296/20; 297/330, 327, 339, 347, 348, DIG. 10, DIG. 4

[56] References Cited

U.S. PATENT DOCUMENTS

| | | | |
|---|---|---|---|
| 1,698,344 | 1/1929 | Mott | 297/339 |
| 2,295,006 | 9/1942 | Philips | 5/62 |
| 2,578,382 | 12/1951 | Thompson | 297/348 |
| 2,694,437 | 11/1954 | Glaser | 280/657 |
| 2,798,565 | 7/1957 | Rosenthal et al. | 180/907 |
| 3,023,048 | 2/1962 | Barton | 297/330 |
| 3,111,181 | 11/1963 | Yatich | 180/6.5 |
| 3,191,990 | 6/1965 | Rugg et al. | 297/83 |
| 3,261,031 | 7/1966 | Gates | 5/86 |
| 3,284,126 | 11/1966 | Piazza | 296/20 |
| 3,379,450 | 4/1968 | Jones et al. | 280/657 |
| 3,393,004 | 7/1968 | Williams | 296/20 |
| 3,406,772 | 10/1968 | Ahrent et al. | 180/9.24 R |
| 3,495,869 | 2/1970 | Ingemansson | 297/71 |
| 3,770,073 | 11/1973 | Meyer | 180/65 R |
| 3,964,786 | 6/1976 | Mashuda | 297/330 |

*Primary Examiner*—John A. Pekar
*Assistant Examiner*—D. Lynn Fugate
*Attorney, Agent, or Firm*—Buell, Blenko, Ziesenheim & Beck

[57] ABSTRACT

The specification discloses improvements in a mechanized wheelchair in which the seat, back and leg members are so linked and articulated on a body frame as to enable the occupant to assume any one of three positions, namely sitting, standing or reclining. By movably mounting the body frame on a base frame the height may also be controlled in conjunction with the above positions. A drive means is also provided and the use of electrical operational means and an improved structural design make this invention safer and more versatile than any disclosed in the art.

4 Claims, 6 Drawing Figures

MECHANIZED WHEELCHAIR

This invention relates to an improved mechanized wheelchair and is an improvement to the wheelchair of my U.S. Pat. No. 3,964,786. Prior art patents show how numerous attempts have provided ever increasing mobility to the occupants of wheelchairs. For example, the use of power means to actuate the articulation of the seat, back and leg rest members can be seen in U.S. Pat. Nos. 2,694,437; 3,191,990; 3,284,126 and 3,495,869. Powered propulsion under the control of the occupant is also known, as can be seen in U.S. Pat. No. 3,111,181. Means for adjusting the elevation of the occupant are disclosed in U.S. Pat. Nos. 3,495,869 and 3,393,004, and finally, U.S. Pat. Nos. 2,295,006; 3,023,048 and 3,379,450 each disclose means to raise the occupant to a standing position.

However, no wheelchair which is adjustable in all the ways above mentioned appears to be known prior to my invention to be described hereinafter. One reason is that in a wheelchair which is fully adjustable it is difficult to achieve stability in every position. Another reason is that mechanisms previously used for adjusting certain of the elements of the chair are not readily compatible with mechansims for making other elements adjustable. The wheelchair of my U.S. Pat. No. 3,964,786, which is an advance over the prior art, had no means for adjusting the elevation of the chair with respect to the wheels. My invention to be described hereinafter has means for elevating the chair and its associated back rest and leg rests regardless of the relative position of those three elements. The stability of my chair hereinafter described in all positions is superior to that of previously known wheelchairs.

Power operated adjustable position wheelchairs quite generally use linear actuators to move the chair elements into the desired positions. Hydraulic cylinders are economical and convenient for this purpose. When the piston of a hydraulic cylinder is extended and supporting load, however, the stability of such support, if not otherwise assisted, is often not all that could be desired. In addition, leakage in the hydraulic system, which is different to eliminate, may permit the piston to slip back into the cylinder. At worst, a patient may be injured by a rapid collapse of his chair. Even a partial or slow collapse far short of injuring the patient may generate a feeling of insecurity which may turn the patient against the wheelchair. In the wheelchair of my invention I preferably employ mechanical actuators electrically driven. My invention, however, is not limited to a wheelchair with mechanical actuators. I construct my wheelchair so that the actuators for the principal elements—the chair seat and chair back—carry maximum load when their pistons are fully retracted in their housings. This construction assures maximum stability of the chair, so making feasible the use of hydraulic cylinders for those actuators when leakage can be kept under control.

I provide a mechanized wheelchair in which the seat, back and leg members are so linked and articulated on a body frame as to enable the occupant to assume any one of three positions, namely sitting, standing or reclining. By movably mounting the body frame on a base frame the height may also be controlled in conjunction with the above positions. A drive and steering means are also provided. The use of electrical operational means and an improved structural design make this wheelchair safer and more versatile than any yet disclosed in the art.

Other details, objects and advantages of the invention will become apparent in the course of the following description of a present preferred embodiment of my invention.

Figure 5:
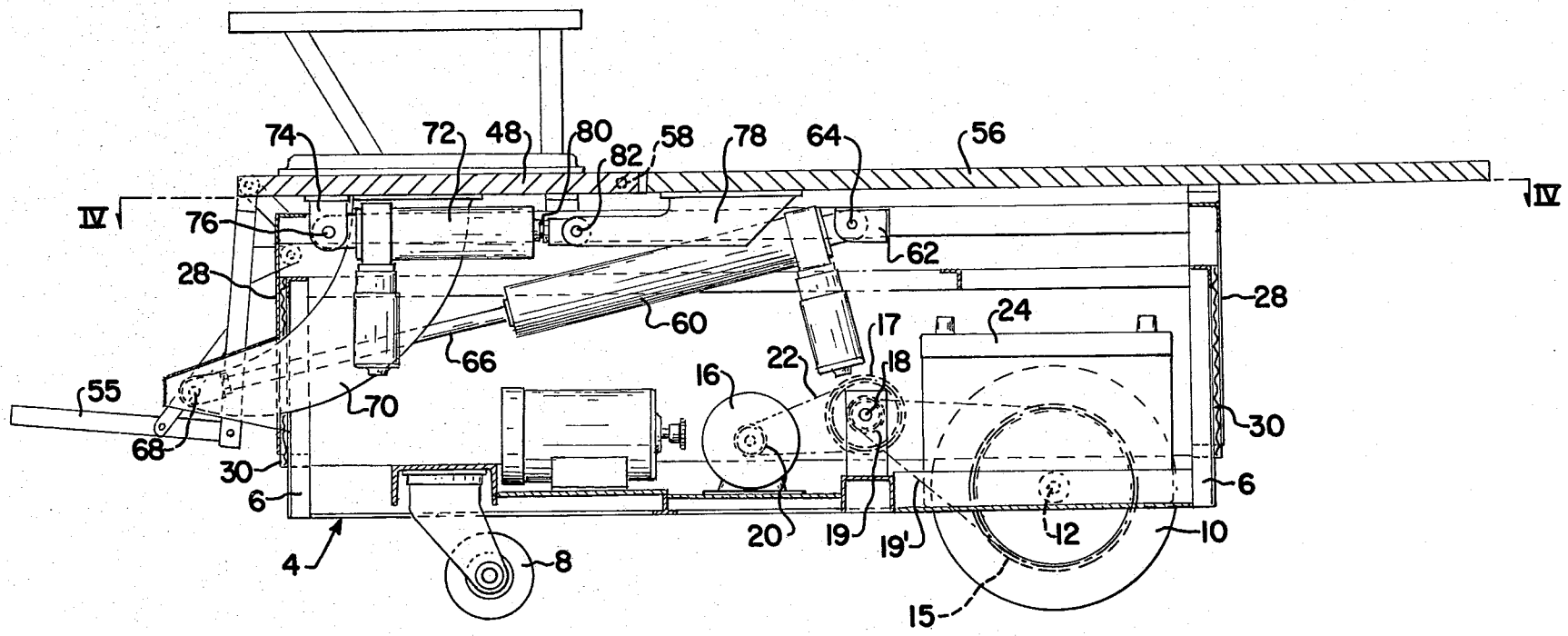
FIG. 5 is a side elevation of my chair taken on the plane V—V of FIG. 4.

Referring to the drawings, the wheelchair 2 comprises a rectangular box type base frame 4 preferably made of aluminum structural members. The base frame has four vertical guide posts 6 as can be seen in FIG. 5. The base frame is supported in front by a pair of castered wheels 8 and in the rear by a pair of drive wheels 10.

The wheelchair's drive means will now be described. The rear drive wheels 10 are mounted on independent axles 12. Each rear wheel has a drive sprocket 15 attached thereto, and an independent, reversible, variable speed motor 16 is mounted on the base frame 4 in front of each of said drive wheels 10. The drive shaft of each motor 16 is fitted with a sprocket 20, and a drive chain 22 connects each motor sprocket 20 to a sprocket 17 keyed to countershaft 18. Shaft 18 has a smaller sprocket 19 keyed thereto and drives wheel sprocket 15 through chain 19; thus providing power to the wheels from the motor. A suitable battery 24 is provided to supply power to all of the wheelchair's motors.

As is shown in all figures, a rectangular box type body frame 26 sized to receive said base frame 4 is provided. The body frame also has four vertical guide posts 28 which telescope on posts 6 of the base frame. A wear strip 30 is attached on each corner of the base frame between the base frame and the body frame to assure that the body frame can be smoothly lifted above the base frame.

Figure 4:
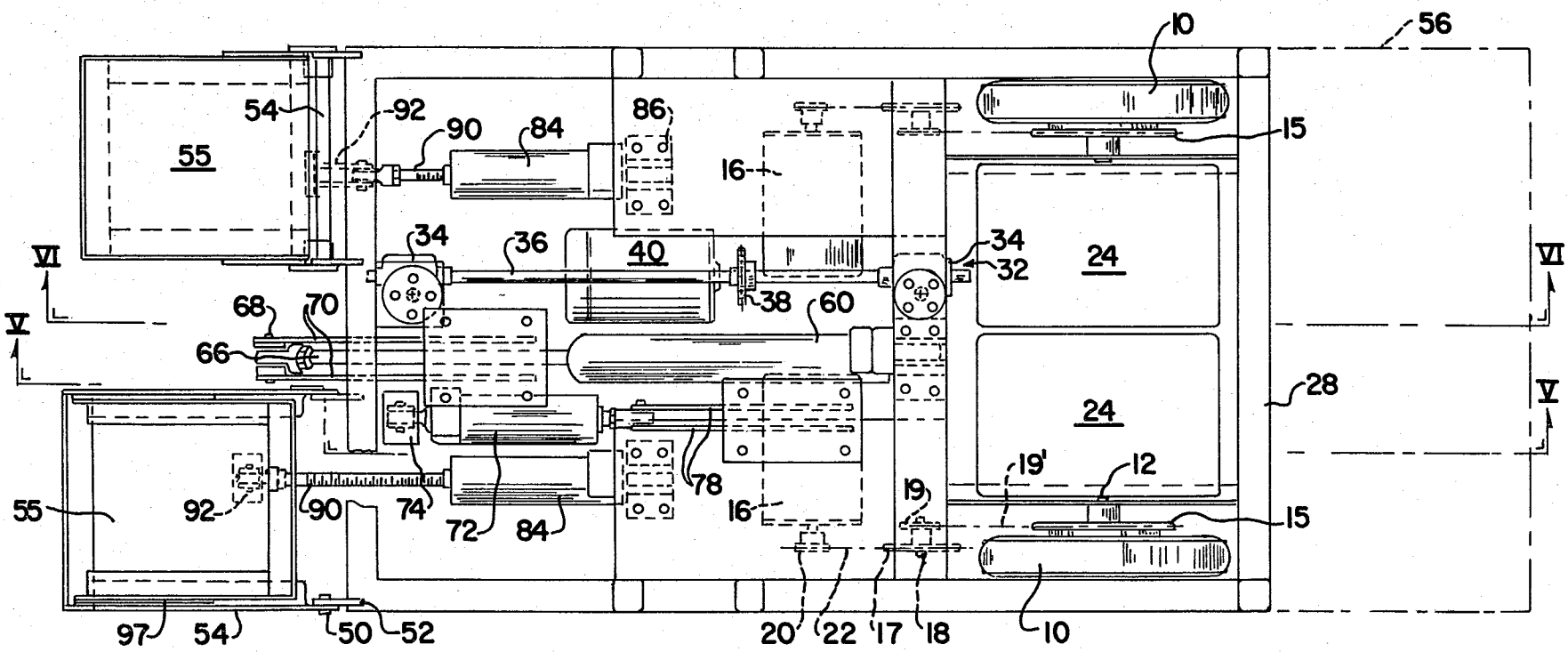
FIG. 4 is a plan of my wheelchair, partly broken away, taken on the plane IV—IV of FIG. 5.
Figure 6:
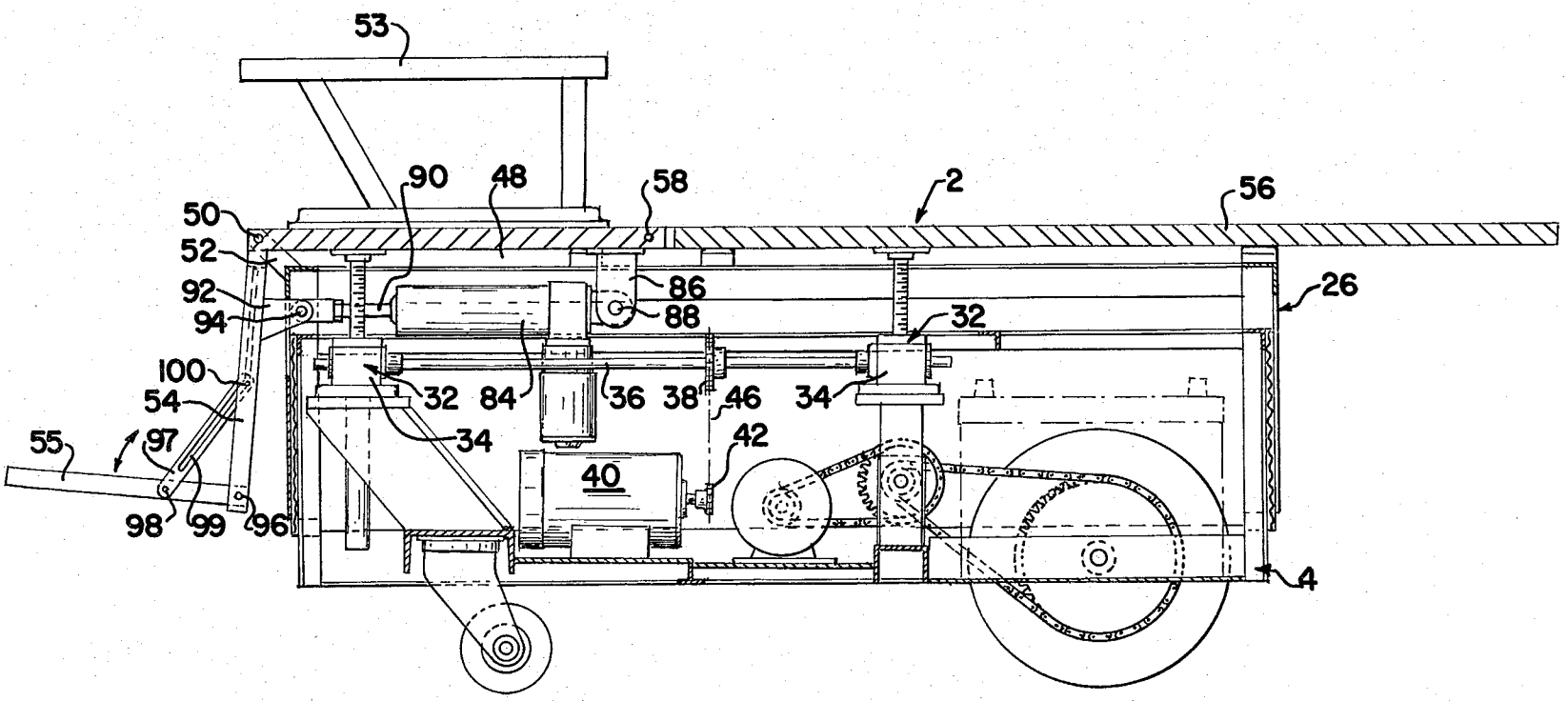
FIG. 6 is a side elevation of my chair taken on the plane VI—VI of FIG. 4.

As illustrated by FIGS. 4 and 6, the body frame 26 can be lifted above the base frame 4 by a pair of vertical lifting devices 34—34, which will now be described in detail. Those devices 34 are mechanical actuators, such as Duff-Norton Machine Screw Jactuators® Units, and are supported on the base frame 4. Those actuators movably connect the base frame to the body frame 26. A shaft 36, with a sprocket 38 mounted near its center, operably connects the actuators 34—34 so that the actuators act as a single unit. A reversible motor 40 having a sprocket 42 fixed to its shaft, is mounted on the base frame. A chain 46 is trained around motor sprocket 42 and shaft sprocket 38. By activating motor 40, the body frame can thus be raised and lowered with respect to said base frame.

The wheelchair 2 further comprises a rectangular seat frame 48, which rests on the top surface of the body frame 26 when the chair is disposed in a sitting or reclining position. The seat frame is pivotally connected at 50 to a pair of brackets 52. The brackets are in turn firmly attached to the upper front corners of the body frame 26 as is shown in FIG. 6. By this arrangement, the seat frame can swing from the horizontal resting position shown in FIG. 1 about said pivot, to the substantially vertical position of FIG. 3, as is required to assist the occupant to a standing position. Arm rest members 53 are attached to each side of the seat frame as shown. A pair of rectangular leg rest members 54 are also pivotally connected to frame 26 at 50 in a manner such that said leg members can swing from their substantially vertical resting position shown in FIG. 1 to a co-planar position with respect to said seat frame as shown in FIG. 2. A rectangular foot rest member 55 is attached to each leg member as shown. A rectangular back rest frame 56, which rests on the top of the body frame 26 when in a reclining position, is pivotally attached to the free end of said seat frame 48 by suitable pivots 58. The back rest 56 can be rotated upwardly from the reclining horizontal position of FIG. 2 to a substantially vertical sitting position shown in FIG. 1. Back, seat and leg rest members can each be provided with suitable cushions.

The power operating means by which the standing, sitting and reclining positions are achieved will now be described. The seat frame 48 is rotated upwardly from its horizontal resting position to a substantially vertical position by a first self-contained electrical mechanical actuator 60, FIGS. 4 and 5, such as a Duff-Norton Mini-Pac ® Mechanical Actuator. The dead end of activator 60 is pivotally connected to a bracket 62 by a pin 64. The bracket 62 is in turn affixed to the body frame 26 to the rear of seat frame 48 as shown in FIG. 5. The actuator rod 66 which extends from the free end of actuator 60 is pivotally connected by pin 68 to a curved lever arm 70, which is preferably made of steel and extends downwardly and forwardly from the seat frame 48, to which it is firmly attached. When the actuator rod 66 is retracted into the actuator 60 the curved lever arm 70 rotates the seat frame 48 about pivot 50 to the vertical standing position shown in FIG. 3.

A second self-controlled mechanical actuator 72 is provided to control the back rest frame. The dead end of actuator 72 is pivotally connected to a bracket 74 by a pin 76. The bracket 74 is mounted on the underside of the seat frame 48 near its forward end. A second bracket 78 is mounted on the underside of the back frame 56 and actuator rod 80 of actuator 72 is pivotally connected by means of a pin 82 to said bracket 78. Relative motions between the back and seat members are controlled solely by this actuator as can be seen in FIGS. 1 and 2.

To control the leg rest members 54 a pair of self-contained actuators 84 is provided. The dead ends of actuators 84 are pivotally connected to a pair of brackets 86 by pins 88. Brackets 86 are attached to the body frame 26 as shown in FIG. 6. The actuator rods 90 extending from the free end of said actuators 84 are connected to brackets 92 by pins 94. Brackets 92 are in turn fastened to the underside of each leg rest member 54. By extending actuator rods 90 the leg members 54 will rotate upwardly from their downward vertical position of FIG. 1 about pivot 50 to the horizontal position shown in FIG. 2.

Figure 1:
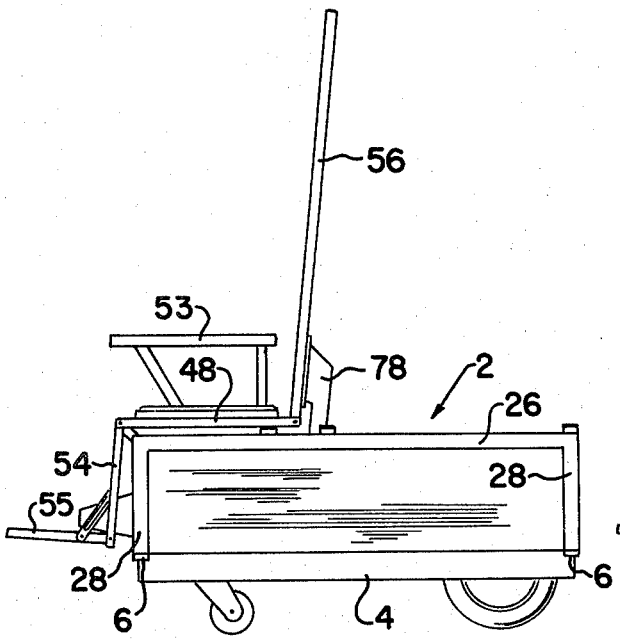
FIG. 1 is a side elevational view, showing my improved wheelchair in the sitting position.
Figure 3:
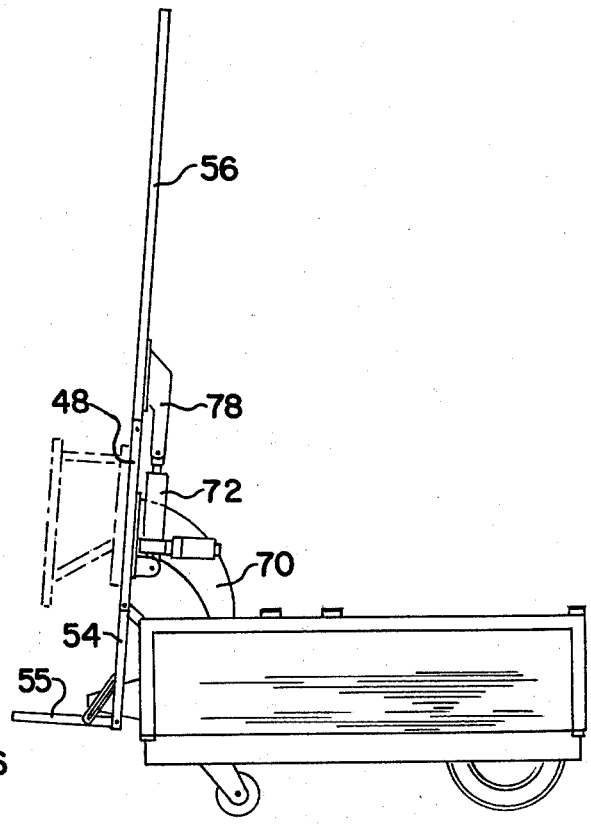
FIG. 3 is a side elevational view, showing the wheelchair of FIG. 1 with the parts positioned in a standing position.
Figure 2:
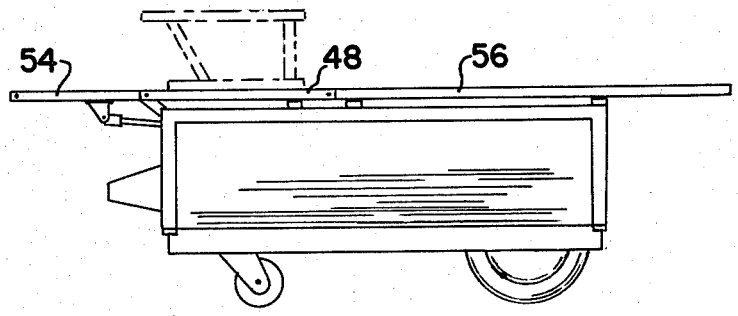
FIG. 2 is a side elevational view showing the wheelchair of FIG. 1 with the parts positioned in a reclining position.

When leg rest members 54 are in their upright position as is shown in FIGS. 1 and 3, foot rest members 55 are at an angle somewhat less than 90° to their leg rest members, as is also shown in those Figures. When leg rest members 54 are aligned with seat 48 and back 56 in the full reclining position of my chair shown in FIG. 2, foot rest members 55 fold into leg rest members 54 at their pivotal junction 96, as is shown in FIG. 6. A brace 97 is pivoted at one end 98 to foot rest 55 intermediate its free end and its junction 96 with leg rest 54. Brace 97 is formed with a longitudinal slot 99 extending from its other end toward its end 98. A pin 100 in leg rest 54 is fitted in slot 99 so that when foot rest 55 is fully extended pin 100 engages the upper end of slot 99, thus causing brace 97 to hold foot rest 55 in that position. When leg rest 54 is raised to its horizontal position and foot rest 55 starts to swing toward it around their pivotal junction 96, brace 97 slides along pin 100 to a position parallel to leg rest 54.

The mechanical actuators which I prefer to use are conventional rotating nut screw jacks driven by electric motors connected by conventional means to separate switches, not shown, conveniently positioned on the chair. My chair is both propelled and steered by the separate drive motors 16 for rear wheels 10 and the castering action of front wheels 8. The chair is propelled in either forward or reverse direction by the two variable speed drive motors 16 acting in concert. It is steered by slowing the drive motor for one wheel and speeding up the drive motor for the other wheel, or, if desired, by reversing the drive motor for one wheel with respect to the motor driving the other wheel. My chair is conveniently provided with a conventional joy stick or control lever, not shown, which controls the speed and direction of drive motors 16.

While I have shown and described a presently preferred embodiment of my invention, I wish to be understood that the invention is not limited thereto, but may be otherwise variously embodied within the scope of the following claims.

I claim:

1. In a mechanized wheelchair of the type comprising a rectangular body frame supported on front and rear pair of wheels, a rectangular seat frame pivotally mounted at its forward end on the forward end of the body frame and being swingable upwardly from a horizontal position in which it rests on the body frame to an upright position, a rectangular back frame pivotally mounted on one end of the rear end of the seat frame being swingable from a horizontal position in which its rear end rests on the body frame to an upright position, a pair of leg rest frames pivotally connected at their upper ends to the forward end of the seat frame and being swingable from a downwardly extending position upwardly into a position co-planar with the seat frame, the improvement comprising a base frame mounted on the wheels at corners of the body frame so as to position the body frame on the base frame for vertical telescoping movement thereon, a lever arm affixed to the bottom of the seat frame extending downwardly therefrom, first power operated means attached to the body frame to the rear end of the seat frame and to the free end of said lever arm for swinging the seat supporting a person from horizontal to upright position by pulling the lever arm, and second power operated means mounted on the base frame and attached to the body frame for raising and lowering the frame supporting a person with respect to the base frame.

2. A mechanized wheelchair according to claim 1 in which the lever arm is curved and extends downwardly and forwardly.

3. A mechanized wheelchair according to claim 1 in which the lever arm is affixed to the bottom of the seat frame rearward of the pivotal mounting of the seat frame on the body frame and extends forwardly of the pivotal mounting of the seat frame on the body frame.

4. A mechanized wheelchair according to claim 1 in which the pivotal mounting of the seat frame on the body frame and the pivotal connection between the seat frame and the leg support frame are coaxial.

* * * * *

UNITED STATES PATENT AND TRADEMARK OFFICE

CERTIFICATE OF CORRECTION

PATENT NO. : 4,407,543

DATED : October 4, 1983

INVENTOR(S) : David Mashuda

It is certified that error appears in the above-identified patent and that said Letters Patent is hereby corrected as shown below:

Column 1, line 44, "different" should be --difficult--.

Column 2, line 38, "chain 19" should be --chain 19'--.

Column 3, line 38, "self-controlled" should be --self-contained--.

Column 4, line 26, after "wish", --it-- should be inserted.

Claim 1, column 4, line 38, "mounted on" should read --mounted at--.

Signed and Sealed this

*Seventeenth* Day of *January 1984*

[SEAL]

*Attest:*

GERALD J. MOSSINGHOFF

*Attesting Officer*

*Commissioner of Patents and Trademarks*